United States Patent [19]

Sainen et al.

[11] Patent Number: 4,843,290

[45] Date of Patent: Jun. 27, 1989

[54] CONTROL SYSTEM FOR ENGAGEMENT PIN IN DURM-TYPE WEFT STORAGE UNIT

[75] Inventors: Tsutomu Sainen, Kanazawa; Kensuke Wakamatsu, Matsuto, both of Japan

[73] Assignee: Tsudakoma Kogyo Kabushiki Kaisha, Ishikawa, Japan

[21] Appl. No.: 947,413

[22] Filed: Dec. 24, 1986

[30] Foreign Application Priority Data

Dec. 28, 1985 [JP] Japan ..... 60-297873

[51] Int. Cl.[4] ..... G05B 1/02

[52] U.S. Cl. ..... 318/603; 139/452; 318/567

[58] Field of Search ..... 139/452; 318/560, 567, 318/603, 626, 625, 671, 564, 571

[56] References Cited

U.S. PATENT DOCUMENTS 4,347,470 8/1982 Kohzai et al. ..... 318/603
4,504,772 3/1985 Matsuura et al. ..... 318/603
4,556,088 12/1985 Tanaka et al. ..... 139/452
4,558,723 12/1985 Tanaka et al. ..... 319/452
4,587,469 5/1986 Ikebe et al. ..... 318/561
4,647,828 3/1987 Wachi ..... 318/603

*Primary Examiner*—William M. Shoop, Jr.
*Assistant Examiner*—David S. Martin
*Attorney, Agent, or Firm*—Wenderoth, Lind & Ponack

[57] ABSTRACT

The present invention relates to a control system for an engagement pin employed in a drum-type weft storage unit which is mainly employed in a jet-loom for storing the weft and for measuring the same in length. A novel control system for an engagment pin employed in a drum-type weft storage unit is provided. An engagement-time is compensated on the basis of a difference in time between a target-time later than the engagement-time of the engagement pin by a normal time-lag, to make it possible that the engagement-time is always set to be optimum in spite of the existanece of variation in shuttling speed of the weft, so that it is possible to keep the variation in length of the delivered weft minimum while the weft feeler is employed in place of the disengagement sensor.

17 Claims, 7 Drawing Sheets

FIG. 2
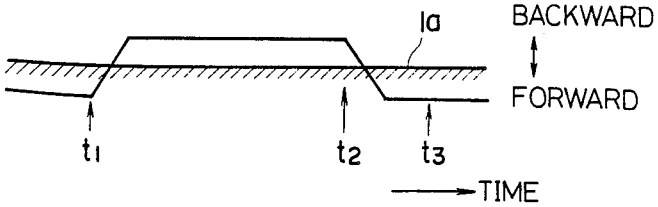
FIG. 4
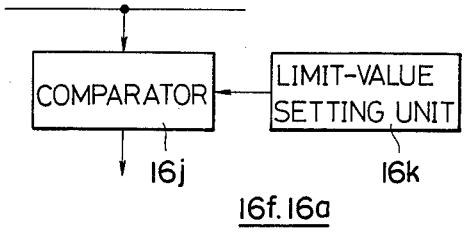
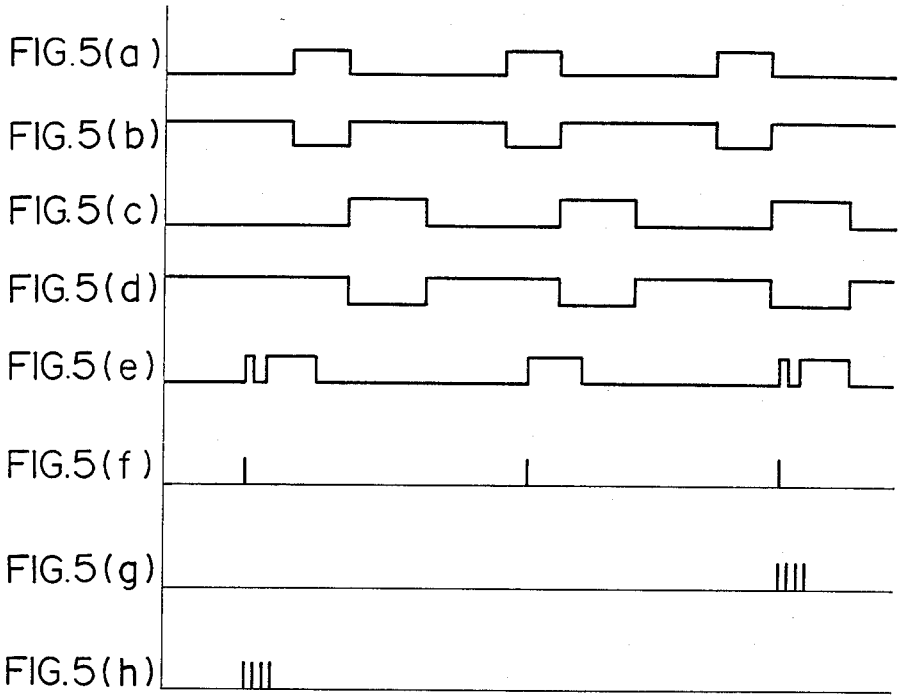

CONTROL SYSTEM FOR ENGAGEMENT PIN IN DURM-TYPE WEFT STORAGE UNIT

BACKGROUND OF THE INVENTION

1. Field of the Invention

The present invention relates to a control system for an engagement pin employed in a drum-type weft storge unit which is mainly employed in a jet-loom for storing the weft and for measuring the same in length.

2. Description of the Prior Art:

It is widely known that the weft is wound on a drum in its outer periphery and stored therein, while subjected to a disengagement/engagement operation from/with the drum by the use of an engagement pin which moves forward and backward relative to the outer periphery of the drum.

In this unit, in order to deliver a predetermined length of the weft from the drum precisely, it is necessary to precisely control a time interval between a disengagement-time at which the engagement pin is retracted from the drum to disengage the weft from the drum and an engagement-time at which the engagement pin is projectecd or moved forward to the drum to engage the weft with the drum, and is also necessary to synchronously control both the disengagement and engagement times with a mechenical ratation-angle of the loom.

In a method for precisely control the engagement pin as described above, the disengagement-time is constantly established by the use of the mechanical rotation-angle of the loom; the number of winding times of the weft delivered from the peripheral surface of the drum is measured by means of a photoelectric sensor which is a so-called disengagement sensor; and the engagement-time is determined upon delivery of a predetermined length of the weft. However, in such method, since a speed of the weft traveling across an optical axis of the disengagement sesnsor is too large, there is an inevitable disadvantage in that the engagement pin is operated in an unstable manner.

In order to eliminate the above disadvantage, for example, Japanese Patent Laid-Open No. 60-65150 teaches a method in which: in place of the disengagement sensor, a so-called "weft feeler" is employed for checking whether the weft is normally picked or not, which weft feeler makes it possible to control the engagement-time of the engaement pin.

This prior art is excellent in that the disentgagement sensor may be omitted. In this prior art, a disenganement time Ts at which the weft is disengaged from the drum by the engagement pin is predetermined, and an arrival time Te at which the tip end of the weft arrives at that side of the woven cloth which is opposite the weft-insertion side is actually measured so that an engagement time Tc of the engagemenet pin is calculated by the following formula:

$$Tc = \overline{T}e - (\overline{T}e - Ts)/(2n)$$

where $\overline{T}$ is a mean amount of movement of the arrival time Te (i.e., a mean value of the arrival time Te in a predetermined number of successive weft-insertion cycles), and n is the number of turns of the weft disengaged from the drum for each picking.

The above formula is based on the fact that the engagement time Tc is between the arrival time Te at which the tip of n turns of the weft disengaged from the drum arrives at that side of the woven cloth which is opposite the weft-insertion side, and the disengagement time Tel at which (n-1) turns of the weft begins to be disengaged from the drum (i.e., $Tel = Ts + (n-1)\cdot(Te - Ts)/n$).

In this connection, it is to be noted that in order for the above formula for Tel to be correct, it must be presupposed that the travelling; speed of the weft during the period from the disengagement time Ts to the arrival time Te be held constant. That is the weft which is picked by a picking nozzle and shuttled must be inserted at a constant speed over the entire cycle of every picking motion, and such travelling speed of the weft must be precisely reproduced upon every weft insertion in order to optimize the engagment time Tc in the following weft-insertion cycle.

In general, the above presupposition is hardly met and hence it is not ensured that the above-described prior art can always give an optimal engagement time Tc. Consequently, if the above measure is reduced into practice, it is difficult to completely prevent variations in the length of the weft being delivered.

SUMMARY OF THE INVENTION

1. Object of the invention:

In view of the problems of such prior art, it is an object of the present invention to provide a novel control system for an engeagement pin employed in a drum-type storage unit, in which control system: and engagement-time is compensated on the basis of a difference in time between a target-time later than the engagement-time of the engagement and an arrival-time of the weft detected by the weft feeler, pin by a normal time-lag, to make it possible that the engagement-time is always set to be optimum in spite of the existence of variation in inserting speed of the weft, so that it is possible to keep the variation in length of the delivered weft minimum while the weft feeler is employed in place of the disengagement sensor.

2. Construction of the invention:

In order to accomplish the above object of the present invention, the control system of the present invention receives both a rotation-angle signal representing a mechanical rotation-angle of a loom and a weft-arrival signal issued from the weft feeler, and is constructed of: a disengagement-time setting means; an engagement-time setting means; a time-lag setting means; a comparison means; a target-time producing means; and a compensation means; in which comparison means the rotation-angle signal is compared with the contents set in the disengagement-time setting means to establish the disengagement-time for disengaging the engagement pin from the drum; in which target-time producing means the target-time later than the engagement-time of the which is the contents of the time-lag setting means is established engagement pin by a normal time-lag; in which compensation means an initial value of the engagement-time established in the engagement-time setting means is sequentially compensated on the basis of the difference in time between the target-time and the arrival-time of the weft; and in which comparison means a signal of the thus compensated engagement-time is compared with the rotation-angle signal, to make it possible to compensate and determine the engagement-time of the engagment pin on the basis of an actual arrival-time of the weft, so that it is possible to always keep the delivered length of the weft optimum even when the shuttling speed of the weft varies. More specifically, in the present invention, instead of predetermining the engagment time by presupposing that the travelling speed of the weft be always constant during every weft insertion, it is considered that the time required for the weft to travel from the engagement time of the engagement pin to the arrival time can be deened constant if it is measured in terms of mechanical rotation angle as a unit. Thus, this is set as a normal time leg by a time-lag setting means so that a difference in time between the arrival time and the target time can be reflected on the engagement time for compensation thereof. As a result of such a control, even if the travelling speed of the weft varies, it is possible to obtain an optimal engagement time at all times. Here, it is to ber noted that the normal time lag is determined in trial weaving tests by first detecting a difference in time between the optimal engagement time at which a predetermined length of weft is disengaged from the drum and the arrival time of the weft at that time, and then converting the time difference into a mechanical rotation angle.

BRIEF DESCRIPTION OF THE DRAWINGS

FIGS. 1 to 5 show an embodiment of the present invention, wherein:

FIGS. 1 is a schematic block-digram of the embodiment;

FIG. 2 is a time-chart illustrating the operation of the engagement pin;

FIG. 3 is a detailed block-diagram of hte embodiment of the present invention;

FIG. 4 is a further detailed portion of the block-diagram shown in FIG. 3; and, FIG. 5A–5H are a time-chart of the pluse signals produced in the system shown in FIG. 3.

FIGS. 6 to 9 show another embodiment of the present invention, wherein:

FIG. 6 is a schematic block-diagram illustrating the construction of the hardware of the system according to the present invention; and, FIGS. 7 to 9 are flowchars illustrating the software programs for operating the system of the present invention.

DESCRIPTION OF THE INVENTION

An embodying example of the present invention will now be described with reference to the accompanying drawings.

Figure 1:
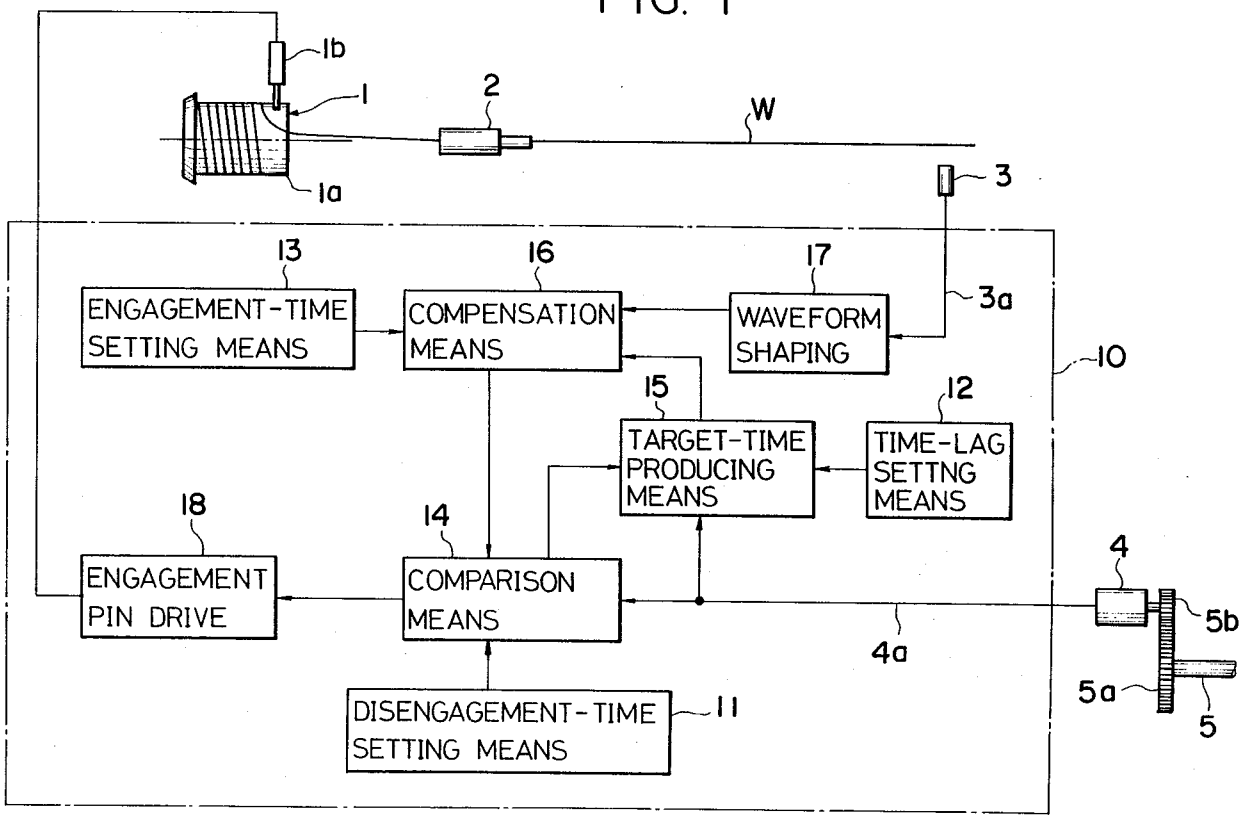

As shown in FIG. 1, a control system 10 for an engagement pin **1*b* employed in a drum-type weft storage unit 1 receives both a rotation-angle signal 4*a* representing a mechanical rotation-angle of a loom, and a weft-arrival signal 3*a* representing an arrival of weft W in a side counter to a weft-entering side termed "picking side"of a woven cloth (hereinafter referred to as the counter-picking side); and is constructed of: a disengagement-time setting means 11; a time-lag setting means 12; an engagement-time setting means 13; a comparison means 14; a target-time producing means 15; and a compensation means 16**.

The weft W is fed from a tread-feeding cone (not shown), and wound on a peripheral surface of a drum **1*a* of the weft storage unit 1 to be stored therein, while subjected to a disengagement/engagement operation in connection with the drum 1*a* by means of the engagement pin 1*b* which conducts a forward/backward motion in connection with the peripheral surface of the drum 1*a*. After completion such disengagement/engagement operation, the weft W passes through a picking nozzle 2 and further passes through a warp-opening termed "shed" in a shuttling manner to reach the counter-picking side of the woven cloth, so that a front end of the weft W is detected by a weft feeler 3. The engagement pin 1*b* is actuated upon receipt of its driving signal issued from the control system 10 of the engagement pin 1*b*, to be moved forward so that a front end of the engagement pin 1*b* ingages with a hole or a groove provided in the peripheral surface of the drum 1*a*. When the front end of the engagement pin 1*b* engages with the hole or groove provided in the peripheral surface of the drum 1*a*, the weft W wound on the peripheral surface of the drum 1*a* is engaged with the drum 1*a*. In contrast with this, when the engagement pin 1*b* is moved backward to be disengaged from the hole or groove of the drum 1*a* in its front end, the weft W is disengaged from the drum 1*a* and delivered therefrom, to make if possible to measure the length of the weft W with the use of a perimeter of the drum 1*a*, which perimeter acts as a unit length in measuring. A time-chart of the forward/backward motion of the front end of the engagement pin 1*b* in connection with the peripheral surface of the drum 1*a* is shown in FIG. 2 wherein: a starting-time $t_1$ of the backward motion of the engagement pin 1*b* is defined as the disengagement-time; a starting-time $t_2$ of the forward motion of the engagement pin 1*b* is defined as the engagement-time; and at a time $t_3$ later than the engagement-time $t_2$ by a certain time-lag resulted from the shutting motion of the weft W, the front end of the weft W is detected by the weft feeler 3**.

As shown in FIG. 1, the weft-arrival signal **3*a* is issued from the weft feeler 3 to the control system 10 of the engagement pin 1*b* , in which control system 10 the weft-arrival signal 3*a* is inputted to the compensation means 16 through a waveform-shaping circuit 17. To the compensation means 16 is inputted a signal issued from the engagement-time means 13. Then, the compensation means 16 issues a signal to the comparison means 14**.

The rotation-angle signal **4*a*, which is a signal issued from an encoder 4 driven by a main shaft 5 of the loom through a gear 5*a* fixed to the main shaft 5 and another gear 5*b* meshing with the gear 5*a*, is inputted to both the comparison means 14 and the target-time producing means 15 to which are also inputted a signal issued from the comparison means 14 and a signal issued from the time-lag setting means 12. Then, the target-time producing means 15 issues a signal to the compensation means 16**.

To the comparison means 14 is further inputted a signal issued from the disengagement-time setting means 11. The output of the comparison means 14 leads to the engagement pin **1*b* through an engagement-pin driving circuit 18**.

Figure 3:
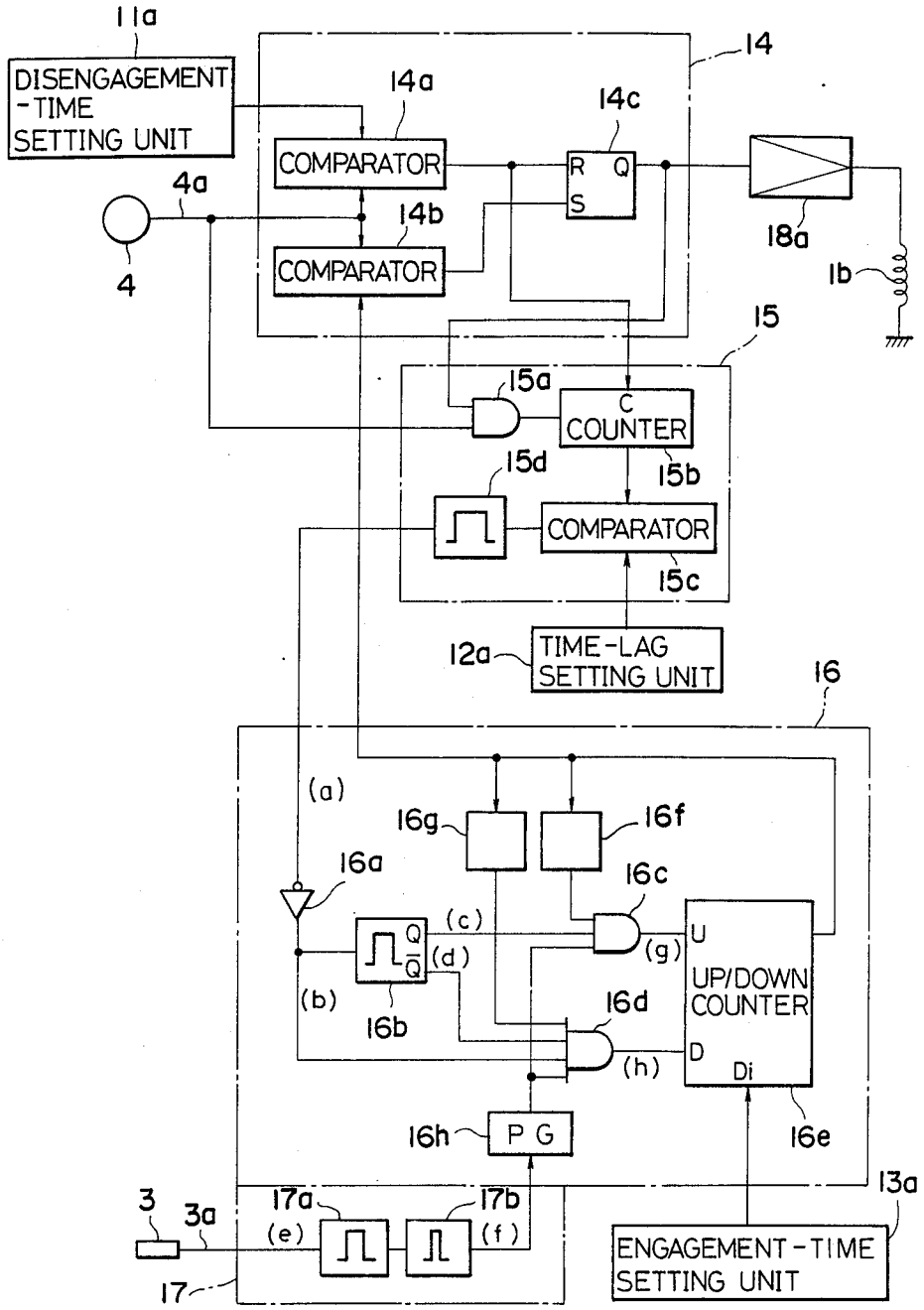

A concrete example of such control system 10 of the engagement pin **1*b* is FIG. 3**.

The rotation-angle signal **4*a*, which is the signal issued from the encoder 4, is inputted to a pair of comparators 14*a*, 14*b* which construct the comparison means 14, while also inputted to an AND-gate, 15*a* which is a component of the target-time producing means 15. On the other hand, to the comparator 14*a* is inputted a signal issued from a disengagement-time setting unit 11*a* corresponding to the disengagement-time setting means 11. A signal issued from the comparator 14*a* is inputted to a reset-terminal R of a flip-flop 14c. In addition, to the other comparator 14b is inputted a signal issued from an up/down counter 16e which is a component of the compenssation means 16. A signal issued from the comparator 14b is inputted to a set-terminal S of the filp-flop 14c, and a signal issued from the flip-flop 14c is inputted to at soleniod for driving the engagement pin 1b through a drive-amplifier 18a which corresponds to the engagement pin driving circuit 18**.

The signal issued from the flip-flop 14c is also inputted to the AND-gate 15a. Then, the AND-gate 15a issues a signal to a counter 15b to a clear-terminal C of which is inputted the signal issued from the comparator 14a. A signal issued from the counter 15b is inputted to the comparator 15c together with a signal issued from a time-lag setting unit 12a corresponding to the time-lag setting means 12. A signal issued from the comparator 15c is inputted to the compensation means 16 through a one-shot-pulse generator 15d, in which means 16 the output passed through the one-shot-pulse generator 15d is inputted to both a mono-multivibrator 16b and an AND-gate 16d through an inverter 16a.

A positive signal and a negative signal both issued from the mono-multivibrator 16b are inputted to an up-terminal U and a down-terminal D of the up/down counter 16e through an AND-gate 16c and the AND-gate 16d, respectively. On the other hand, to a data-input terminal Di of the up/down counter 16e is inputted a signal issued from an engagement-time setting unit 13a which is corresponding to the engagement-time setting means 13. A signal issued from the up/down counter 16e is inputted to the comparator 14b of the comparison means 14 as described above, while also inputted to the AND-gate 16c and 16d through an up-inhibiting circuit 16f and a down-inhibiting circuit 16g, respectively.

As shown in FIG. 4, each of the up-inhibiting circuit 16f and the down-inhibiting circuit 16g is constructed of, for example, a comparator 16j and a limit-value setting unit 16k a signal issued from which is inputted to the comparator 16j.

Further, as shown in FIG. 3, the weft-arrival signal 3a which is a signal issued from the weft feeler 3 is inputted to the AND-gates 16c and 16d through the waveform-shaping circuit 17 and a pluse generator 16h, which circuit 17 comprises doubled mono-multivibrators 17a amd 17b, wherein the pluse generator 16h receives one pulse to issue a predetermined number of pulse-signals.

An operation of the control system 10 of the engagement pin 1b is as follows.

In the disengagement-time setting unit 11a, the disengagement-time of the engagement pin 1b is set. Under such circumstances, the loom is operated to cause its main shaft 5 to rotate so that the encoder 4 issues the rotation-angle signal 4a. When the roration-angle signal 4a issued from the encoder 4 coincides with the signal of the disengagement-time issued from the disengagement-time setting unit 11a, the comparator 14a of the comparison means 14 issues a signal to the flip-flop 14c to reset the same 14c so that the engagement pin 1b is moved backward relative to the peripheral surface of the drum 1a after receipt of signal issued from the flip-flop 14c through a drive-amplifier 18a, whereby the weft W engaging with the peripheral surface of the drum 1a is disengaged from the drum 1a and picked through the picking nozzle 2. In this case, the drive-amplifier 18a incorporates an overexcitation circuit for the driving soleniod of the engagement pin 1b, so that it is possible to neglect a time-lag produced between the flip-flop 14c and engagement pin 1b in their operation.

Since the signal issued from the comparator 14a is also inputted to the clear-terminal C of the counter 15b in the target-time producing means 15, the counter 15b is cleared by means of the output of the comparator 14a.

On the other hand, at a time when a power-supply switch of the control system 10 is turned on, a data-loading circuit (not shown) is actuated to load the up/-down counter 16e with data representing the initial value of the engagement-time established in the engagement-time setting unit 13a. Since the signal issued from the up/down counter 16e is inputted to the comparator 14b, when the rotation-angle signal 4a coincides with a signal of the initial value of the engagement-time, the flip-flop 14c is set upon receipt of the signal issued from the comparator 14b, so that the engagement pin 1b is moved forward to cause the weft W to be engaged with the drum 1a.

At the same time, since the AND-gate 15a is opened upon receipt of the signal issued from the flip-flop 14c, the rotation-angle signal 4a is inputted to the counter 15b which has been previously cleared, so that the counter 15b begins to measure a mechanical rotation-angle produced after the engagement-time which depends on the contents of the up/down counter 16e. In this case, the counter 15b measures least significant bit of the rotation-angle signal 4a. Namely, the counter 15b can identify the least resolving power of the rotation-angle signal 4a.

When the comparator 15c detects that the contents of the time-lag setting unit 12a and corresponds to a time interval between the engagement-time of the engagement pin 1b and the arrival-time of the weft W in the counter-picking side of the woven cloth, the one-shot-pulse generator 15d is actuated, and, as shown in FIG. 5(*a*), issues a pulse signal with predetermined time-length having a waveform (a).

Such pulse signal (a) is inverted in polarity through the invertor 16a to become an inverted-pulse signal (b) as shown in FIG. 5(*b*). Thus inverted signal (b) is inputted to the mono-multivibrator 16b, so that the mono-multivibrator 16b issues a positive-pulse signal (c) and a negative-pluse signal (d)as shown in FIG. 5(*c*) and FIG. 5(*d*), pulse-length of which signals (c) and (d) depend on a time-constant of the mono-multivibrator 16b.

On the other hand, when the front end of the weft W is detected by the weft feeler 3, the weft-arrival signal 3a having a waveform (e) is produced as shown in FIG. 5(*e*). Since the weft-arrival signal 3a passes through the waveform-shaping circuit 17 constructed of the doubled mono-multivibrators 17a and 17b one of which has a sufficiently large time-constant and the other of which has a sufficiently small time-constant, the weft-arrival signal 3a eventually becomes a one-shot-pulse signal (f) as shown in FIG. 5(*f*) even when the waveform of the front end portion of the weft-arrival signal 3a is distrurbed by the vibration of the weft W. In this case, when the arrival-time of the weft W is earlier than the target-time at which the one-shot-pluse generator 15d issues its pulse signal, the mono-multrivibrator 16b is still not actuated at a time when the waveform-shaping circuit 17 issues its pulse signal (f). As shown in a left column of FIG. 5, the mono-multivibrator 16b is in a low level in its positive-output signal while in a high level in its negative-output signal. Consequently, since the signal issued from the pulse generator 16h opens the AND-gate 16d together with the signal issued from the invertor 16a, a predetermined number of pulse signals (h) issued from the pulse generator 16h are inputted to the down-terminal D of the up/down counter 16e, so that the contents of the up/down counter 16e is decreased.

Since the contents of the up/down counter 16e is comparator with the rotation-angle signal 4a in the comoparator 14b to determine the engagement-time of the engagement pin 1b for the picking motion conducted in the following cycle, the engagement-time is sequentially compensated to be advanced by a time corresponding to a compensation amount of the mechanical rotation-angle which corresponds to the number of the pulse signals issued from the pulse generator 16h for every picking motion of the weft W in the same manner as that described in the above, provided that the arrival-time of the weft W is earlier than the target-time.

In contrast with this, in case that the arrival-time of the weft W is later than the target-time, since the mono-multivibrator 16b is actuated upon receipt of the signal issued from the invertor 16a and continues its actuation as shown in a right column of FIG. 5 at a time when the pulse signal (f) is issued, the compansation-pulse signal issued from the pulse generator 16h is applied to the up-terminal U of the up/down counter 16e through the AND-gate 16c as a pulse signal (g) as shown in FIG. 5(*g*), so that the engagement-time is compensated to sequentially delay, provided that the time-constant of the mono-multivibrator 16b is so determined that the mono-multivibrator 16b continues its operation for a period of time which is sufficiently longer than that required to issue all the compensation-pulse signals from the pulse generator 16h.

In this case, since the compensation amount of the engagement-time in every picking motion of the weft W depends on the number of the pulse signals issued from the pulse generator 16h which constitutes a compensation-amount defining element for defining a compensation amount for each engagement; any number of the pulse signals may be employed, provided that such number is at least one. In addition, it is naturally preferable that the pulse signal is sufficiently rapid in rate.

As shown in a central column of FIG. 5, in case that the arrival-time of the weft W is sufficiently close to the target-time, that is, in case that the pulse signal issued from the one-shot-pulse generator 15d nearly overlaps in time with the pulse signal (f), since the mono-multivibrator 16b is not actuated, the AND-gate 16c is closed, while the AND-gates 16d is also closed upon receipt of the signal issued from the invertor 16a. Consequently, the compensaation pulse issused from the pulse generator 16h is not inputted to any of the up-terminal U and the down-tereminal D, so that the engagement-time is not compensated. Namely, the minimum value of the difference in time between the target-time and the arrival-time of the weft W for effectively conducting the above compensation depends on the length of the pulse signal, issued from the one-shot-pulse generator 15d.

Since each of the up-inhibiting circuit 16f and the down-inhibiting circuit 16g is constructed of the limit-value setting unit 16k and the comparator 16j, when the compensation amount of the engagement-time becomes excess so that the signal issued from the up/down counter 16e overflows the maximum allowance which depends on a value estabished in the limit-value setting unit 16k, only one of the AND-gates 16c and 16d which corrects such excess condition is opened, while the other of the AND-gates 16c and 16d is closed. Consequenly, the limit-value setting unit 16k acts to determine the variation allowance of the engagement-time.

Figure 6:
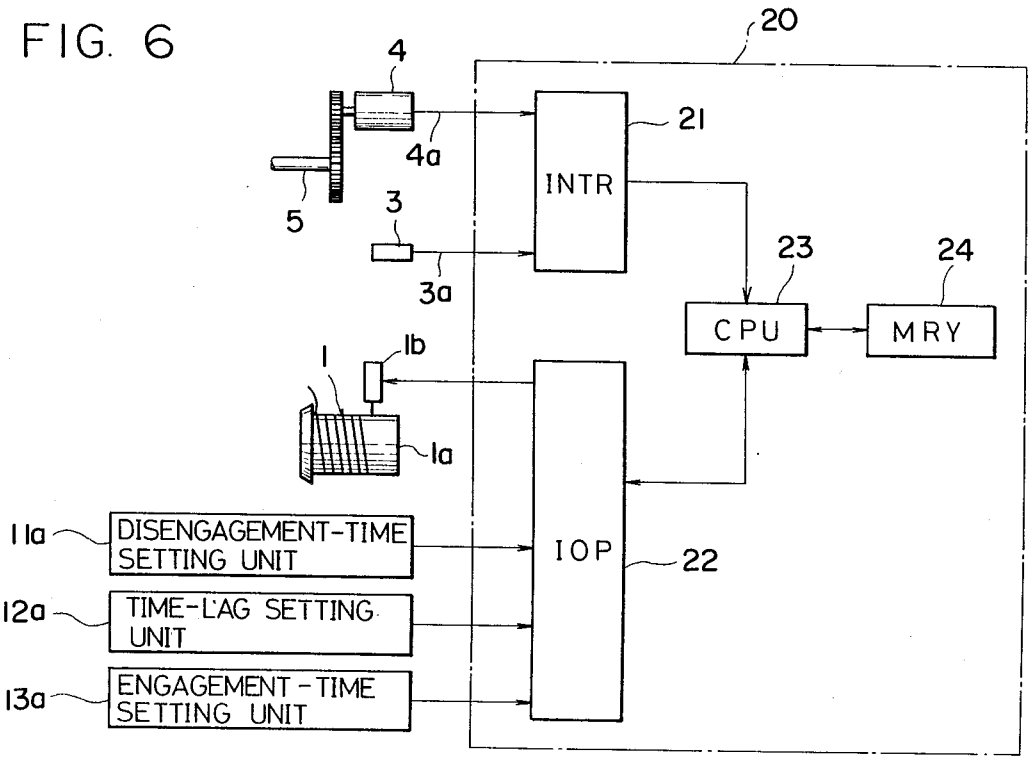

Another Embodiment of the Invention:

As shown in FIG. 6, the control system 10 of the engagement pin 1b may be realized by employing a software program according to which is employed a micro-computer 20 provided with: an interrut-control unit 21 (hereinafter referred to as the INTR 21); an input/output control unit 22 (hereinafter referred to as the IOP 22); a central processing unit 23 (hereinafter referred to as the CPU 23); and a memory unit 24 (hereinafter referred to as the MRY 24), provided that both the weft-arrival signal 3a issued from the weft feeler 3 and the rotation-angle signal 4a issued from the encoder 4 are inputted to the CPU 23 through the INTR 21, while each of the driving signal for the engagement pin 1b is outputted and each of the values established in the disengagement-time setting unit 11a, time-lag setting unit 12a and the engagement-time setting unit 13a is inputted, from/to the CPU 23 through the IOP 22.

Figure 7:
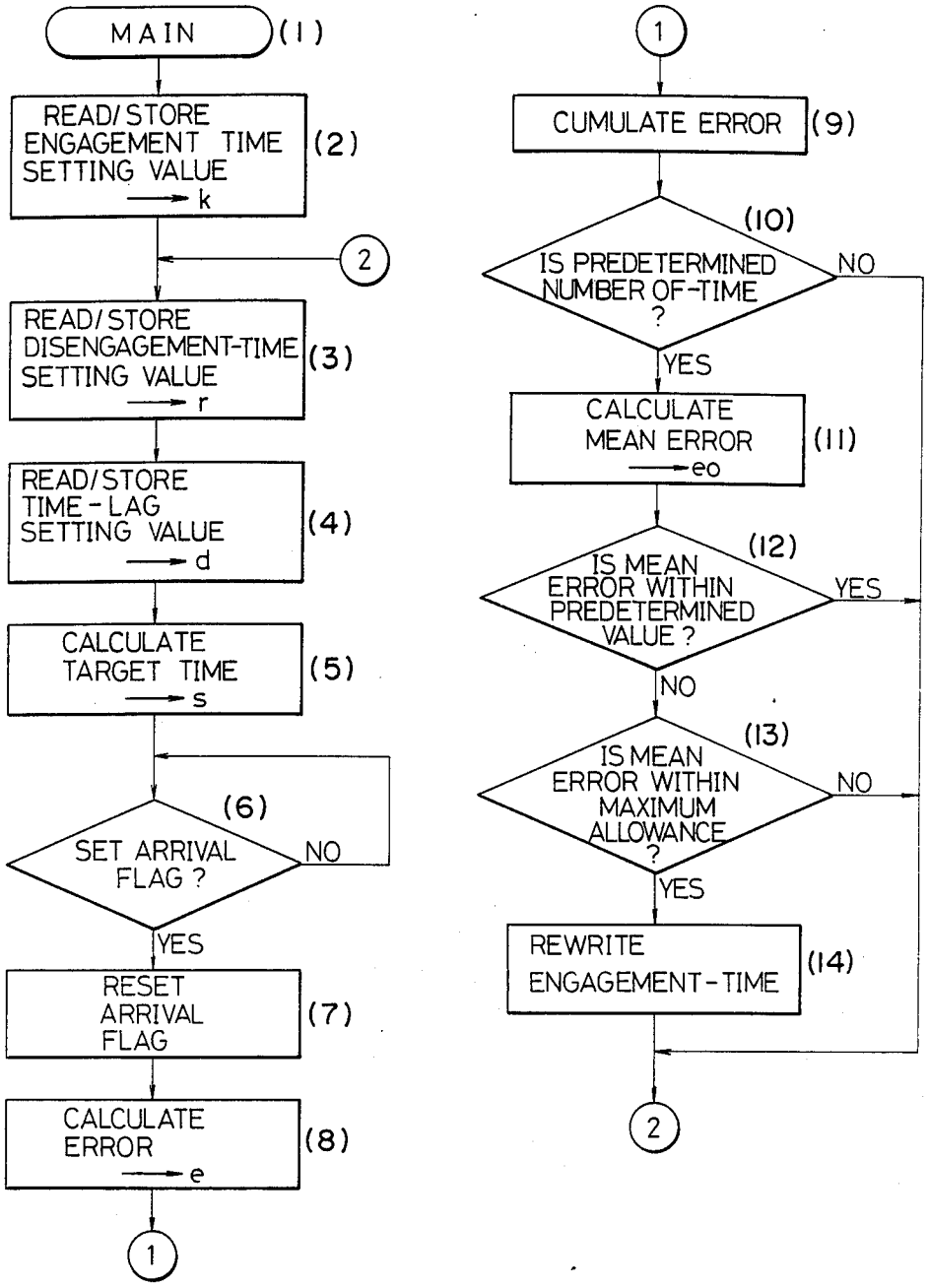
Figure 8:
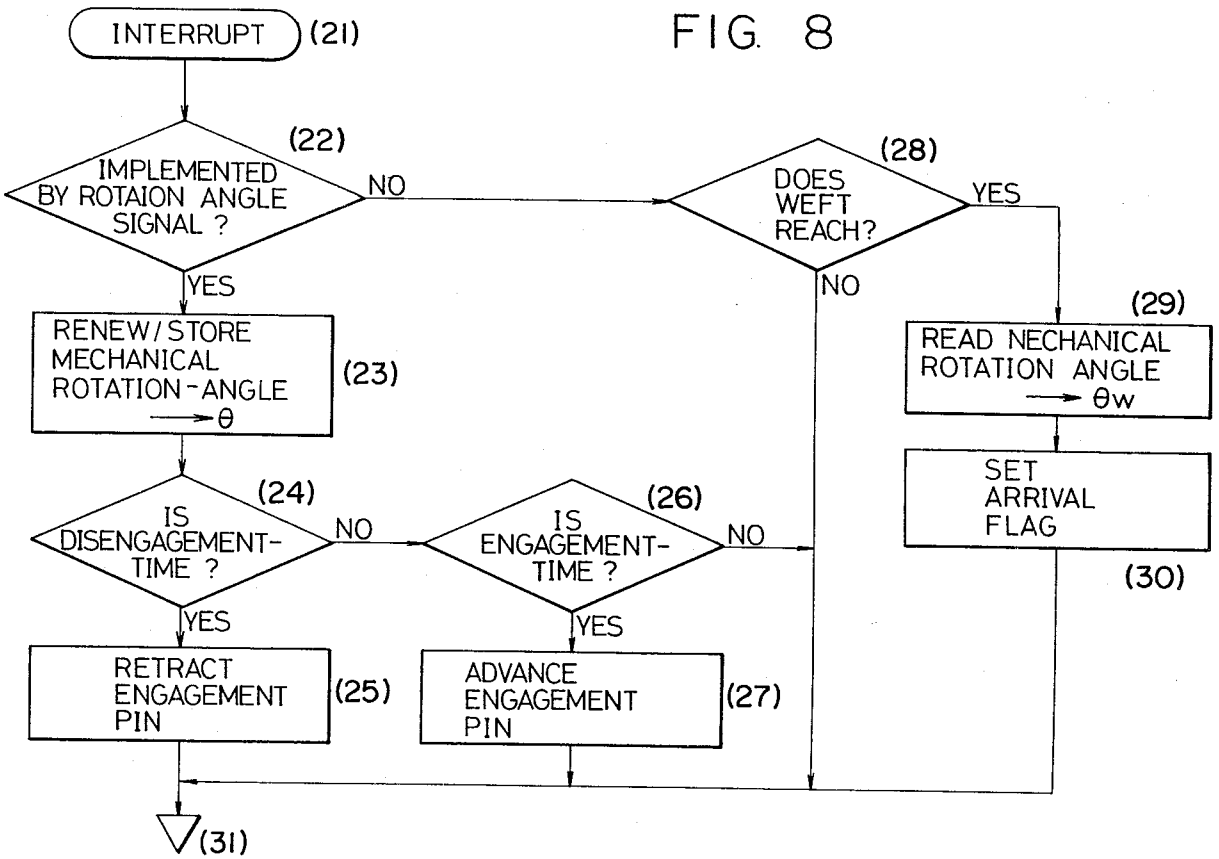

As shown in FIG. 7 and 8, a software program implemented by the micro-computer 20 is constructed of a main routine and an interrupt routine implemented upon receipt of both the weft-arrival signal 3a and the rotation-angle signal 4a.

As shown in FIG. 7, in a step 1, firstly, the main routine is implemented; in a step 2, the value establish in the engagement-time setting unit 13a is read and stored as an initial value k of the engagement-time; in steps 3 and 4, the values r and d established in the disengagement-time setting unit 11a and the time-lag setting unit 12a respectively are read and stored respectively; in a step 5, the target-time s is calculated according to an equation: $s=k+d$; and, in a step 6, the arrival of the weft W is waited for.

As shown in FIG. 8, in a step 21, when the weft feeler 3 issues the weft-arrival signal 3a upon arrival of the weft W, the interrupt routine is implemented; in steps 22 and 28, the arrival of the weft W is confirmed; in a step 29, a present value of the mechanical rotation-angle $\theta$w of the loom which has been stored renewedly in a step 23 is read; and, in a step 30, an arrival flag is established.

As shown in FIG. 7, in a step 6, since the main routine recognizes the arrival of the weft W through such establishment of the arrival flag, such flag is reset in a step 7, and then, an error e produced between the mechanical rotation-angle $\theta$w having been read in the step 29 and the target-time s having been calculated in the step 5 is found out in a step 8. The thus found-out error e is added in a cumulative manner in a step 9. Then, in a step 10, the processes of the steps 3 to 9 are repeated a predetermined number of times corresponding to that of the picking motions of the weft W, while a mean error $e_o$ is calculated in a step 11. Upon recognition of the fact that the mean error $e_o$ is larger than a predetermined value in a step 12 and also upon recognition of the fact that the mean error $e_o$ is within the maximum allowance in a step 13, the engagement-time k is compensated in a rewriting manner in a step 14 according to an equation: $k=k+e_o$. In this connection, it is to be noted that the steps 8, 10, 11 and 14 constitute a mean value calculating element which calculates a mean value eo of the difference e between the target time s and the arrival time of the weft W in a predetermined number of sucessive weft-insertion operations so as to compensate for the engagement time K.

Figure 9:
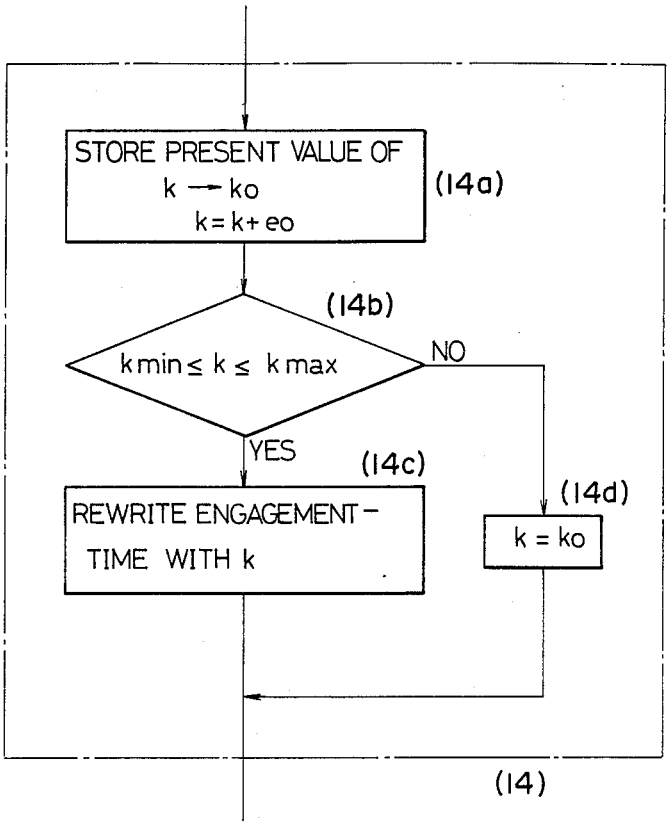

Incidentally, the detail of the step 14 for rewriting the engagement-time k is shown in FIG. 9. Namely, the present value k of the engagement-time k is stored as $k_o$, while the equation: $k=k+e_o$ is calculated in a step 14*a*. In a step 14*b*, it is judged whether the result of such calulation is within an allowance ranging from $k_{min}$ to $k_{max}$. In a step 14*c*, according to the result of such judgment, it is decided whether the engagement-time k is actually rewritten or whether the engagment-time k is returned to its initial value without rewriting.

As shown in FIG. 8, in steps 21 and 22, when the interrupt routine is implemented upon receipt of the rotation-angle signal 4*a*, the mechanical rotation-angle $\theta$ of the loom is renewed and stored in a step 23. Then, in step 24, it is judged whether the present mechanical rotation-angle $\theta$ corresponding to the disengagement-time r. As a result, in case that the rotation-angle $\theta$ corresponds to the disengagement-time r, a signal for retracting the engagement pin 1*b* is issued in a step 25. On the other hand, in step 26, in case that it is recognized that the present mechanical rotation-angle $\theta$ corresponds to the engagement-time k having been compensated in the step 14, the signal fo advancing the engagement pin 1*b* is issued. Since the engagement-time k is sequentially compensated in a rewriting manner in the step 14, a time for advancing the engagement pin 1*b* is sequentially compensated according to the above compensation.

In this embodiment of the present invention, since the compensation amount of the engagement-time k depends on the mean value $e_o$ of the error e produced in the predetermined number of the continuous picking motions of the weft W, the engagement-time k may more repidly converge on its optimum value in a stable manner.

Further, the compensation amount of the engagement time k can be applied $e_\theta/n$ (n is an arbitrary positive number 1 larger than 1.) in stead of the mean value $e_O$. Generally, the error e between the arrival-time and the target-time, which is issued in the counter-picking side, is issued by enlarging the er or in the picking side, namely, the variation amount of the time needed to disengage thoroughly the one pick weft W from the outer periperal surface of the drum l*a* by the picking nozzle 2. Thus when the error e or the mean value $e_O$ is applied as the compensation amount to the engagement-time k, the compensation amount is selected lower than the mean value $e_O$ since the compensation amount might be to excess, so that it is prevented to be vibrationally the convergence to the optimum value of the engagement-time k. Thus it is possible to embody more rapid and the stabilized control. In this case, the steps 8, 10, 11 and 14 of FIG. 7 serve to calculate the mean value eo of the difference e between the target time s and the arrival time of the weft W in a predetermined number of successive weft-insertion operations and compensate for the engagement time k using 1 /n of the mean value eo thus calculated. In this connection, the formula shown in the step 14*a* in FIG. 9 is expressed as follows:

$$K=K+eo/n$$

In comparing the flowcharts shown in FIGS. 7 and 8 with the system shown in FIG. 1, it is clear that: the steps 23, 24 and 26 correspond to the comparison means 14; the step 5 corresponds to the target-time producing means 15; and the steps 6 to 14 and the septs 28 to 30 correspond to the compensation means 16.

Incidentally, the step 12 show in FIG. 7 defines a so-called dead-band for the compensation, which corresponds to the width of the pulse signals issued from the one-shot-pulse generator 15*d* shown in FIG. 3, that is, the one-shot pulse generator 15*d* of FIG. 3 and the step 12 of FIG. 7 constitute a dead-band element which detects whether or not the difference between the target time s and the arrival time of the weft W is greater than a predetermined value, and permits the compensation means 16 to operate only when such a difference is greater than the predetermined value. On the other hand, the step 14*b* corresponds to both the up-inhibiting circuit 16*f* and the down-inhibiting circuit 16*g* both of which are shown in FIG. 3, that is, the up-inhibiting circuit 16*f* and the down-inhibiting circuit 16*g* of FIG. 3 and the step 14*b* of FIG. 9 constitute a limiting element which defines an allowable variation range of the engagement time. Since the steps 12 and 13 are employed to enhance the safety of the control system 10 of the present invention, it is possible to neglect the steps 12 and 14*b*. In case that the steps 12 and 14*b* are neglected, it is necessary that each of the predetermined value employed in the step 12 and the maximum allowance employed in the step 14*b* are determined to be a sufficiently large value or allowance.

In addition, without employing each of the disengagement-time setting unit 11*a*, time-lag setting unit 12*a* and the engagement-time setting unit 13*a*, it is also possible to realize each of the functions of the disengagement-time setting means 11, time-lag setting means 12 and the engagement-time setting means 13 like software by the use of the micro-computer 20 to which each of the data being established in these units 11*a*, 12*a* and 13*a* have been previously inputted and stored in the MRY 24 thereof, which micro-computer 20 is operated in the same manner that described above.

Incidentally, when the arrival signal 3*a* of the weft W is inputted to the micro-computer 20, it is naturally preferable that the signal 3*a* passes through the wave-form-shaping circuit 17 employed in the first embodiment of the present invention or passes through a circuit similar to the circuit 17 to be converted into the one-shot-pulse signal. Effect of the Invention:

As described above, according to the present invention, both the rotation-angle signal 4*a* and the weft-arrival signal 3*a* are inputted to the control system 10 in which: the target-time later than the engagement-time of the engagement pin 1*b* by the normal time-lag is established in the target-time producing means 15; in the compensation means 16 provided therein the engagement-time is compensated to be advanced or delayed by the use of the difference in time between the target-time and the arrival-time of the weft W; in the comparison means 14 provided therein, the rotation-angle signal 4*a* is compared with the signal of the thus compensated engagement-time while compared with the disengagement-time signal, so that the engagement-time is compensated to be advanced or delayed on the basis of the actual arrival-time of the weft W in the counter-picking side of the woven cloth, whereby it is possible to always realize the optimum engagement-time. Consequently, even if the inserting speed of the weft W varies in every picking motion thereof, it is possible to keep the variation of the delivered length of the weft W minimum. This is an excellent effect of the present invention.

In addition, since both the rotation-angle signal 4a and the weft-arrival signal 3a are pulse signals, these signals 3a and 4a may be advantageously processed in the micro-computer 20 in its data-processing to make it possible to easily realize the entire control system 10 with the us of the micro-computer 20. This is another effect of the present invention.

What is claimed is:

1. In a control system for an engagement pin employed in a drum-type weft storage unit, including a drum for storing a weft in its outer peripheral surface on which the weft is wound and an engagement pin movable toward and away from the peripheral surface of the drum for selectively engaging and disengaging the weft with the drum, the improvement comprising: a disengagement-time setting means connected to receive a rotation-angle signal representative of a mechanical rotational angle of a loom and a weft-arrival signal representative of the arrival of the weft at that side of a woven cloth which is opposite a weft entering side thereof for setting a disengagement time of said engagement pin from said drum, said disengagement-time setting means being operable to generate an output signal representative of the disengagement time thus set; an engagement-time setting means for setting an initial value of the engagement time of said engagement pin; a time-lag setting means for setting a normal time lag between the engagement time of said engagement pin and the weft-arrival time; a comparison means for comparing the rotation-angle signal with the output of said desengagement-time setting means and the output signal of a later-mentioned compensation means for determining a driving time at which said engagement pin is driven to operate; a target-time generating means for generating a target time which is delayed from the engagement time of said engagement pin by the normal thime lag; and said compensation means compensating for engagement time of said engagement pin based on a difference in time between the target time and the arrival time of the weft, said compensation means being operable to generate an output signal representative of a compensation amount of the engagement time.

2. The control system according to claim 1, further comprising a deadband element for determining whether or not the difference between the target time and the weft-arrival time is greater than a predetermined value, and wherein said compensation means is operated through said deadband element.

3. The control system according to claim 1, wherein said compensation means comprises a limiting element for defining an allowable variation range of the engagement time.

4. The control system according to claim 2, wherein said compensation means comprises a limiting element for defining an allowable variation range of the engagement time.

5. The control system according to claim 1, wherein said compensation means comprises a compensation-amount defining element for defining a compensation amount for each engagement time.

6. The control system according to claim 2, wherein said compensation means comprises a compensation-amount defining element for defining a compensation amount for each engagment time.

7. The control system according to claim 1, wherein said compensation means comprises a compensation-amount defining means defining a compensation amount for each engagement time, and a limiting element for defining an allowable variation range of the engagement time.

8. The control system according to claim 2, wherein said compensation means comprises a compensation-amount defining means for defining a compensation amount for each engagement time, and a limiting element for defining an allowable variation range of the engagement time.

9. The control system according to claim 1, wherein said compensation means comprises a mean-value calculating element which calculates a mean value of the difference between the target time and the weft-arrival time for a predetermined number of successive weft-engagement operations, and compensates for the engagement time using the mean value thus obtained.

10. The control system according to claim 2, wherein said compensation means comprises a mean-value calculating element which calculates a means value of the difference between the target time and the weft-arrival time for a predetermined number of successive weft-engagement operations, and compensates for the engagement time using the mean value thus obtained.

11. The control system according to claim 1, wherein said compensation means comprises a mean-value calculating element which calculates a mean value of the difference between the target and the weft-arrival time for a predetermined number of successive weft engagement operations, and compensates for the engagement time using the mean value thus obtained, and a limiting element for defining an allowable variation range of the engagement time.

12. The control system according to claim 2, wherein said compensation means comprises a mean-value calculating element which calculates a mean value of the difference between the target time and the weft-arrival time for a predetermined number of successive weft-engagment operations, and compensates for the engagement time using the mean value thus obtained, and a limiting element for defining an allowable variation range of the engagement time.

13. The control system according to claim 1, wherein said compensation means comprises a mean-value compensation element which calculates a mean value of the difference between the target time and the weft-arrival time for a predetermined number of successive weft-engagement operations so as to compensate for the engagement time using 1/n (n is an arbitrary positive number greater than (1) of the mean value thus obtained.

14. The control system according to claim 2, wherein said compensation means comprises a mean-value compensation element which calculates a mean value of the difference between the target time and the weft-arrival time for a predetermined number of successive weft-engagement operations so as to compensate for the engagement time using 1/n (n is an arbitrary positive number greater than 1) of the mean value thus obtained.

15. The control system according to claim 1, wherein said compensation means comprises a mean-value compensation element which calculates a mean value of the difference between the target time and the weft-arrival time for a predetermined number of successive weft-engagement operations so as to compensate for the engagement time using 1/n (n is am arbitrary positive number greater than 1) of the mean value thus obtained, and a limiting element for defining an allowable variation range of the engagement time.

16. The control system according to claim 2, wherein said compensation means comprises a mean-value compensation element which calculates a mean value of the difference between the target time and the weft-arrival time for a predetermined numberof successive weft-engagement operations so as to compensate for the engagement time using 1/n (n is an arbitrary positive number grater than 1) of the mean value thus obtained, and a limiting element for defining an allowable variation range of the engagement time.

17. The control system according to any one of claims 1 through 16, wherein said target-time generating means measures the lowermost bit of the rotation-angle signal.

* * * * *